US008177027B2

(12) United States Patent
Borra et al.

(10) Patent No.: US 8,177,027 B2
(45) Date of Patent: May 15, 2012

(54) SAFETY MEASURE FOR A PITCHED ROOF

(75) Inventors: Hans Antonius Borra, Zeist (NL); Anthonie Bernardus Berlee, De Bilt (NL)

(73) Assignee: Dachband GmbH, Engelberg (CH)

( * ) Notice: Subject to any disclaimer, the term of this patent is extended or adjusted under 35 U.S.C. 154(b) by 915 days.

(21) Appl. No.: 11/547,772

(22) PCT Filed: Apr. 5, 2005

(86) PCT No.: PCT/NL2005/000251

§ 371 (c)(1), (2), (4) Date: Jul. 31, 2007

(87) PCT Pub. No.: WO2005/098166

PCT Pub. Date: Oct. 20, 2005

(65) Prior Publication Data

US 2008/0017446 A1 Jan. 24, 2008

(30) Foreign Application Priority Data

Apr. 5, 2004 (NL) ..... 1025885

(51) Int. Cl.
*E04G 3/26* (2006.01)

(52) U.S. Cl. ..... 182/45

(58) Field of Classification Search ..... 182/45
See application file for complete search history.

(56) References Cited

U.S. PATENT DOCUMENTS

| | | | | |
|---|---|---|---|---|
| 4,220,328 | A * | 9/1980 | Crush, Jr. | 482/92 |
| 5,137,112 | A * | 8/1992 | Nichols | 182/3 |
| 5,699,875 | A | 12/1997 | Dugan | |
| 5,727,646 | A | 3/1998 | Gray | |
| 2002/0096395 | A1 | 7/2002 | Garrett | |

FOREIGN PATENT DOCUMENTS

| | | |
|---|---|---|
| EP | 0 074 011 A2 | 8/2002 |
| FR | 2 593 542 A1 | 7/1987 |

* cited by examiner

*Primary Examiner* — Alvin Chin Shue
(74) *Attorney, Agent, or Firm* — The Webb Law Firm

(57) ABSTRACT

Safety measure for accessing a pitched roof. A belt provided with loops for anchoring a person who accesses the roof is proposed. This belt is permanently installed on the roof slab and under the horizontal battens that support the roof elements, such as tiles. After removing one or more tiles, the belt, and more particularly the loops thereof, is exposed and a safety measure can be provided.

15 Claims, 4 Drawing Sheets

SAFETY MEASURE FOR A PITCHED ROOF

BACKGROUND OF THE INVENTION

1) Field of the Invention

The present invention relates to an assembly comprising a pitched roof and a belt fixed to said roof, which belt extends in the direction of the pitch of said roof, wherein said roof comprises a structural part, provided with horizontal battens for supporting roof covering elements thereon, said belt being fixed to said structural part under said battens and extends from top to bottom underneath said horizontal battens.

2) Description of the Related Art

Such an assembly is disclosed in EP 0 074 011. In this publication a rafter roof is described, the tile battens being linked to one another by a strip that takes up the load and is fixed to the rafters.

FR 2 593 542 discloses a supporting construction to be installed on a pitched roof. This construction consists of a belt that is wrapped around a relatively high anchorage, such as a beam, in the roof slab. This belt is then threaded between the roof elements, such as tiles, to the outside, after which this is connected to a foot for, for example, scaffolding. An additional belt is fastened to this foot, to which additional belt a foot located lower down for the same construction is fastened.

After completion of the work, the construction comprising the belts described above is removed.

Access to pitched roofs on which tiles or other roof covering elements have been fitted is effected by laying aside the tiles concerned and the person accessing the roof supports himself on the tile battens. However, when a roof becomes older and/or if there are knots or the like in the tile battens it cannot be guaranteed that the tile battens are able to support the weight of the person concerned. It is also possible that said person loses his footing. In all cases there is the risk that he falls from the roof, with all the associated consequences.

Therefore increasingly more stringent safety regulations are being introduced by the government. Ultimately, people who access the roof must be firmly fastened to an anchorage point in a safe manner under all circumstances, so that in the case of a possible fall the person does not slip off the roof, but the consequences thereof are restricted. Another safety measure consists in installing scaffolding and fitting nets.

Such a safety measure can, for example, be realised starting from the belt described in FR 2 593 542 A. However, just like all other safety systems, this has the disadvantage that a safety measure first has to be installed on the roof before the start of work and the safety measure has to be removed thereafter. The installation and removal step is associated with an unsafe situation. During this stage the people who are working on the roof are unprotected.

SUMMARY OF THE INVENTION

In order to solve this problem it is proposed in the art to provide hooks that are permanently present. These extend to the exterior between the roof covering elements and a lanyard or the like can be fastened thereto. Although such a construction is adequate, in principle each protruding part constitutes a risk with regard to leakage of the roof. Moreover, it must be guaranteed that such a hook is fixed to the roof sufficiently firmly, which imposes particular requirements on the construction. Moreover, there is a risk that if the person on the roof still takes a tumble despite everything, he will be injured by these protruding parts.

The system described in EP 0 074 011 is not intended at all as a safety measure.

The aim of the present invention is to provide a safety system that does not have these disadvantages, that is to say can be installed permanently, is easily accessible and does not have the risk of injuring the user.

This aim is realised with a system as described above in that anchor members are arranged on said belt a regular distance apart, said anchor members being designed for coupling a safety lanyard thereto.

Here structural part must be understood to be any type of roof boarding or roof construction, with or without layers of insulation and further soundproofing and/or water-resistant layers. The present invention can be used with constructions where the horizontal battens that support the roof covering elements, such as tiles, are some distance away from the roof slab. For this purpose, in general there will be vertical battens that extend from top to bottom. The anchor belt according to the present invention can be permanently installed in the gap between these vertical battens. This belt extends from top to bottom and can be anchored to the roof slab at a number of fixing points. Such anchoring is preferably made where the anchoring or purlins are located under the roof slab. Should one of the fixing points give way during use, this has no consequence because of the continuous nature of the belt and the large number of fixing points to the anchoring.

Another application is with so-called rafter roofs, where the tile battens are fitted directly on supporting rafters for the roof which are of relatively heavy construction. With this arrangement the belt is fixed directly on the side or indirectly on the top of the rafter. Consequently, the belt does not have to be joined to the tile battens and can be arranged a slight distance away therefrom.

The anchor members according to the invention can be simple loops made in the belt. According to a further variant of the present invention it is possible to make the anchor members from separate parts, such as from a housing that is provided with a coupling part. A further coupling part of, for example, a safety lanyard can be (temporarily) connected to such a coupling part. Such a separate part can either be fixed to the belt in advance or can be fixed thereto on the building site.

According to a particular embodiment of the invention the belt is made up of belt parts that extend in parallel and are, for example, located one above the other. These belt parts are fixed to one another regular distances apart. With this arrangement according to a particularly advantageous embodiment one belt part is fixed to said roof in some way or other and the other belt part serves for fixing the anchor member, such as a housing. With such a construction it is possible, in particular, to fix the belt to the roof in advance (in the construction workshop and/or factory) and to fit the anchor member on site, as a result of which account can be taken of varying distances between the tile battens.

According to an advantageous embodiment of the invention, the belt consists of a textile fabric. More particularly, the belt consists of a fabric made of plastic material of high tensile strength, such as material that is used in the production of seat belts in vehicles. More particularly, the plastic material that is used can withstand ultraviolet radiation and other external weather effects.

The person who accesses the roof can be attached to the belt in any way known in the art. Lanyards and the like provided with self-locking hooks can be provided for this purpose. Grappling constructions can optionally be used. According to an embodiment described above, the anchor belt consists of a belt provided with loops, to which fastenings to the user's lanyard or the like can easily be fitted. According to an advantageous embodiment of the invention, such loops are made by locally folding over the belt and fixing it to itself. That is to say, there are no breaks in the belt material. It is also possible to make the belt double and to fix the two parts locally to one another. The seatings for lanyard constructions and the like are produced in this way.

When the coupling described above is used the safety lanyard is preferably made up of a belt with a further coupling part, fitted on the free end thereof, with an anchorage from which locking lips protrude such that they can be moved. These can engage or snap into the coupling part. The lanyard described above can be fastened directly to a person, but also to scaffolding or the like, as described below.

It will be understood that a chain or other part that can be wound up can be used instead of a belt. It is even possible to use a section that has the same functionality as the belt described above.

Furthermore, it is possible to fit the anchor members individually. That is to say, only the belt or the like is installed on the roof under the tile battens and the anchor members, such as loops or anchoring, have to be fastened when a person accesses the roof. For this purpose there is preferably a quick coupling system between such individual anchor members and the belt installed on the roof. Such a coupling system is preferably constructed such that there is either perfect locking between belt and anchor member or the anchor member is not fastened to the belt at all, so that an unsafe situation cannot arise.

The engagement members can then, in particular, be designed for the desired task.

Furthermore, separately providing loops gives rise to the advantage that if the loops become worn only the loops have to be replaced and not the entire construction.

According to an advantageous embodiment of the invention various belts arranged in parallel alongside one another and extending from top to bottom are installed. If these are installed in such a way that the fixing points for a safety facility, such as a user's lanyard, are at the same height, it is possible to arrange constructions extending horizontally between them without adjustment of such constructions being needed. If, for example, the anchor belt is provided with engagement members, such as loops, it is possible to slide a tube, self-locking hooks or adapters of, for example, a quick coupling system through two loops located some distance apart at the same height and to construct scaffolding thereon. It is also possible to install a platform, safety rail, scaffolding or the like in this way.

It will be understood that as a result of the permanent presence of the anchor belt according to the invention the requisite safety is directly available for all work on the roof. Furthermore, it is not necessary to remove the anchor belt. The anchor belt is automatically protected against external weather effects by fitting the roof elements. The presence of the anchor belt has no influence whatsoever on the functioning of the effect of the roof elements. That is to say, the placing thereof is not impeded by the presence of the anchor belt.

The invention also relates to an anchor belt to be used with the assembly described above. The length thereof is preferably between 4-14 m. However, it must be understood that it is also possible to position the belt around the roof, i.e. the ridge, so that it extends downwards on either side of a ridge roof. A particularly high degree of safety is obtained as a result. According to an advantageous embodiment of the invention, there are at last five possible anchoring points per metre in the anchor belt.

It is also possible to make individual openings in the belt for fixing to the anchoring. If this is the case, such openings are preferably at the location with multiple material thickness, that is to say in the case of a belt with loop at the location where the loop branches off from the belt.

The belt according to the present invention can be installed either in a new building or later on. In the case of new building, the anchor belt according to the invention will preferably be installed before fitting the battens extending horizontally. In the case of existing buildings, the belt will be threaded underneath these battens during the fixing thereof.

BRIEF DESCRIPTION OF THE DRAWINGS

The invention will be explained in more detail below with reference to an illustrative embodiment shown in the drawing. In the drawing.

DETAILED DESCRIPTION OF THE INVENTION

Figure 1:
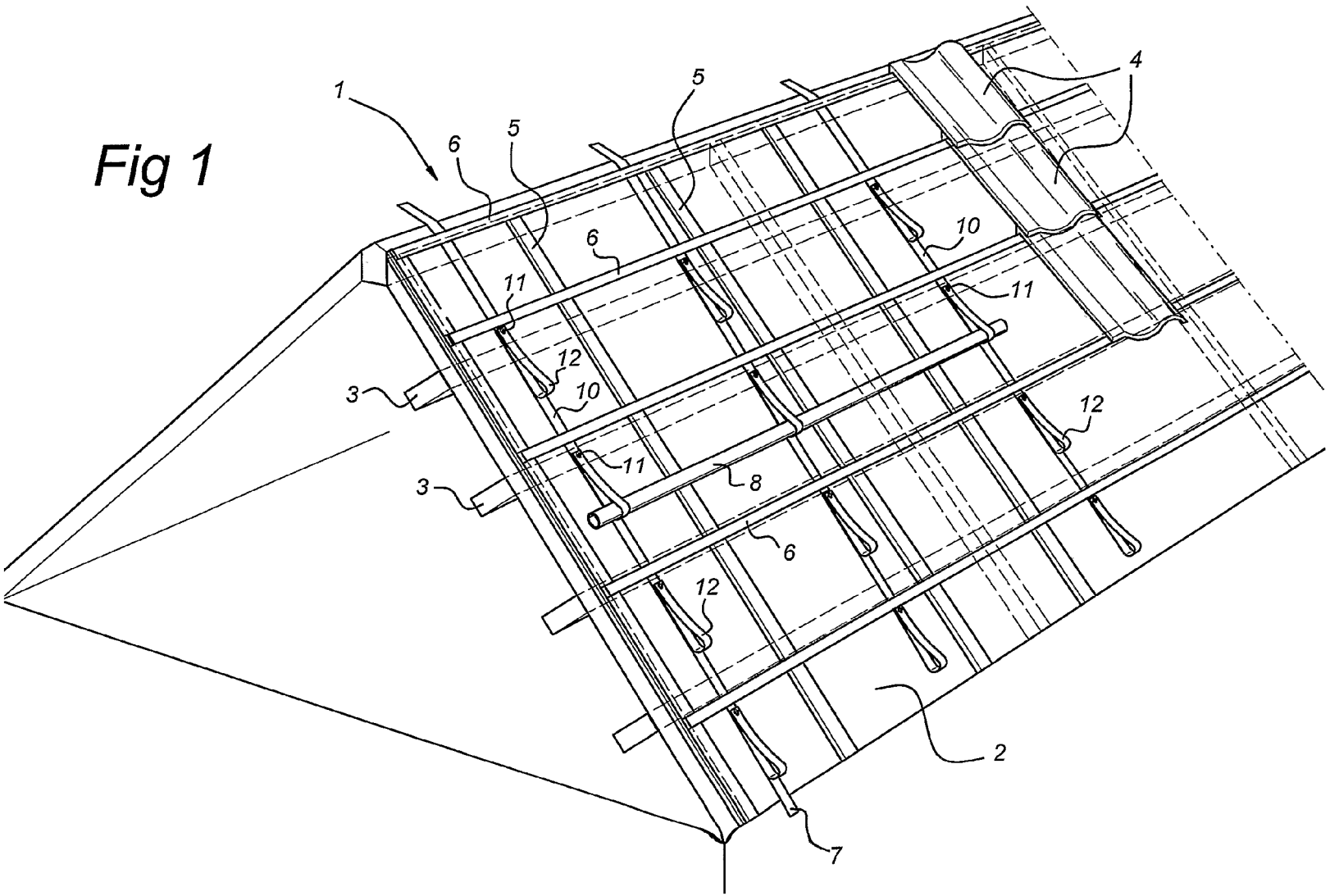
FIG. 1 shows, diagrammatically, part of a pitched roof provided with the safety measure according to the present invention.

In FIG. 1 a ridge roof is indicated by 1. The roof construction is conventional and consists of a roof slab 2 that can have some construction or other. This bears on purlins or anchoring 3. Vertical battens 5 and horizontal battens 6 are fitted on the roof slab 2. These horizontal battens are some distance away from the roof slab, so that dirt, water and the like can move downwards beneath the horizontal battens 6 and optimum ventilation of the outer part of the roof is provided. Tiles 4 are laid on the horizontal battens.

According to the present invention an anchor belt 10 is installed on the roof slab 2 and underneath the horizontal battens. The fixings, which can consist of simple threaded anchor bolts or the like that anchor in the roof slab 2, are indicated by 11. For greater strength the fixings 11 are made in the beams 3, passing through the roof slab 2. The anchor belt is provided with loops regular intervals apart. According to the invention there are at least five possible fixing points per metre and according to an advantageous embodiment two of these are used per metre.

Figure 2:
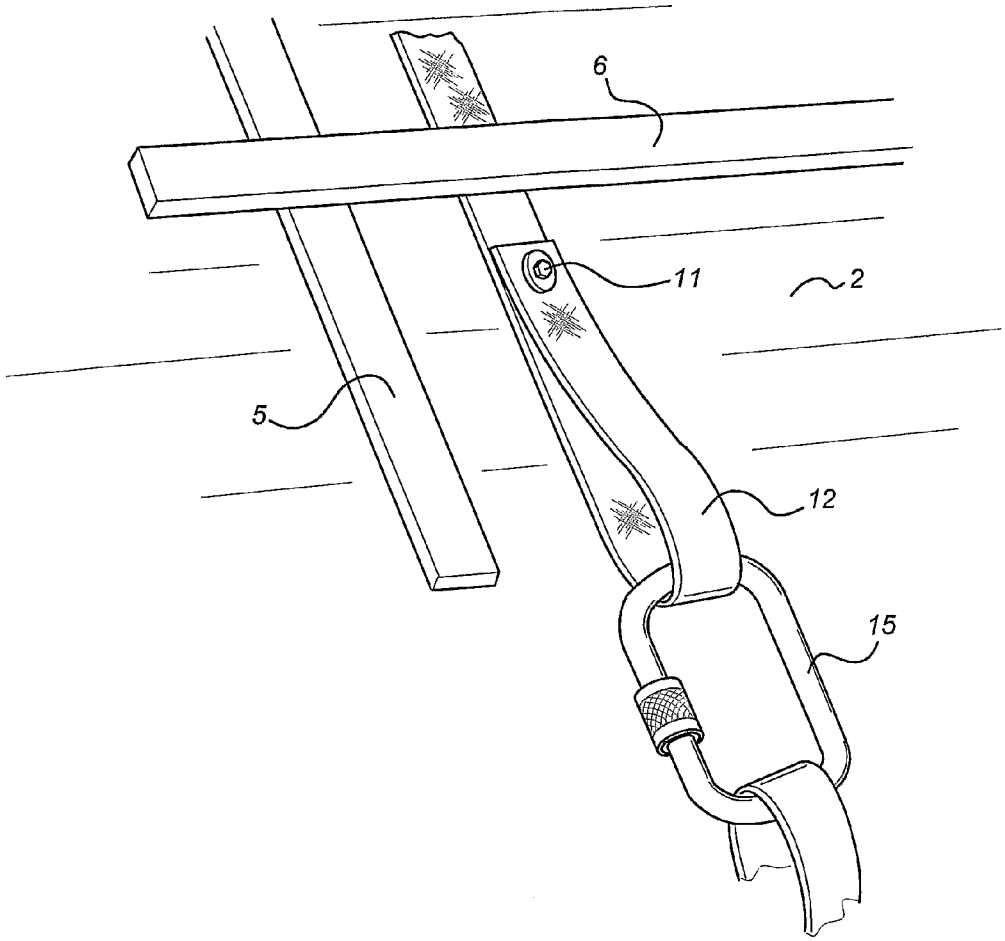
FIG. 2 shows a detail of the construction shown in FIG. 1.

The construction of vertical batten 5 and horizontal batten 6 as well as the fixing 11 can be seen in detail from FIG. 2. It can also be seen from this figure that a hook 15 of a safety lanyard or the like has been fitted in loop 12.

Figure 3:
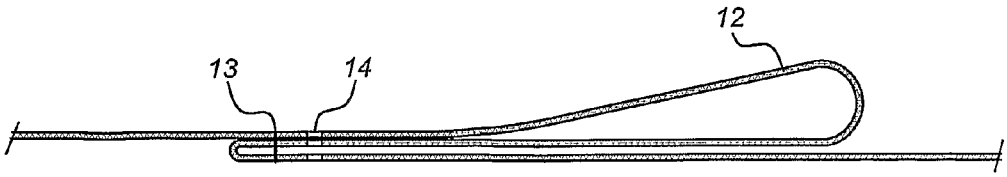
FIG. 3 shows a detail of the anchor belt according to the present invention.

It can be seen from FIG. 3 that the loops are produced by folding over part of the belt material and then fixing it. This fixing can be achieved with sewing by means of seam 13. The fixing 11 is preferably made in position 14, by means of which an opening is indicated.

If a roof construction has not yet been provided with the anchor belt 10 according to the present invention this will preferably be installed from bottom to top. That is to say the lowest fixing point is made while standing on a ladder or scaffolding and in this way work progresses slowly upwards. As a result the worker can secure himself straight away with respect to the roof, so that safety is already available when installing the anchor belt.

It can be seen from FIG. 1 that various such anchor belts 10 can be installed alongside one another. A tube 8, on which a further scaffolding construction can be installed, can, for example, be inserted in the loops that are thus located alongside one another. This can be repeated at a higher level. Furthermore, such a scaffolding construction can be drawn tight to the roof. The length of the anchor belt of course corresponds to the length of the roof. However, it is also possible to make this twice as long, as a result of which it can be positioned over the ridge and is effective on both sides.

It will be understood that when the tiles 4 are present the anchor belt according to the invention cannot be seen from the outside and is protected against external weather effects. Optionally, indicators for the presence of the anchor belt can be provided at the bottom of the roof, that is to say where the bottom tile emerges above the gutter, so that the person who has to go onto the roof immediately knows that his safety lanyard can be fastened at that point. This can be achieved, for example, by making the end of the belt weather-resistant (part 7), for example by vulcanising and allowing it to protrude in the interface between the bottom tile and gutter. As long as one is not at gutter height, this part is not visible from the outside. Instead of a belt it is possible to use a wire rope or the like.

By means of suitable construction and positioning of the loops or other fastening means with respect to the roof tiles or other roof covering made up of parts it is possible to bring the loops or the like to the outside in the overlap region between two tiles or the like. As a result, the roof remains watertight even when carrying out work. The loops can optionally be provided with a protective sleeve.

Figure 4:
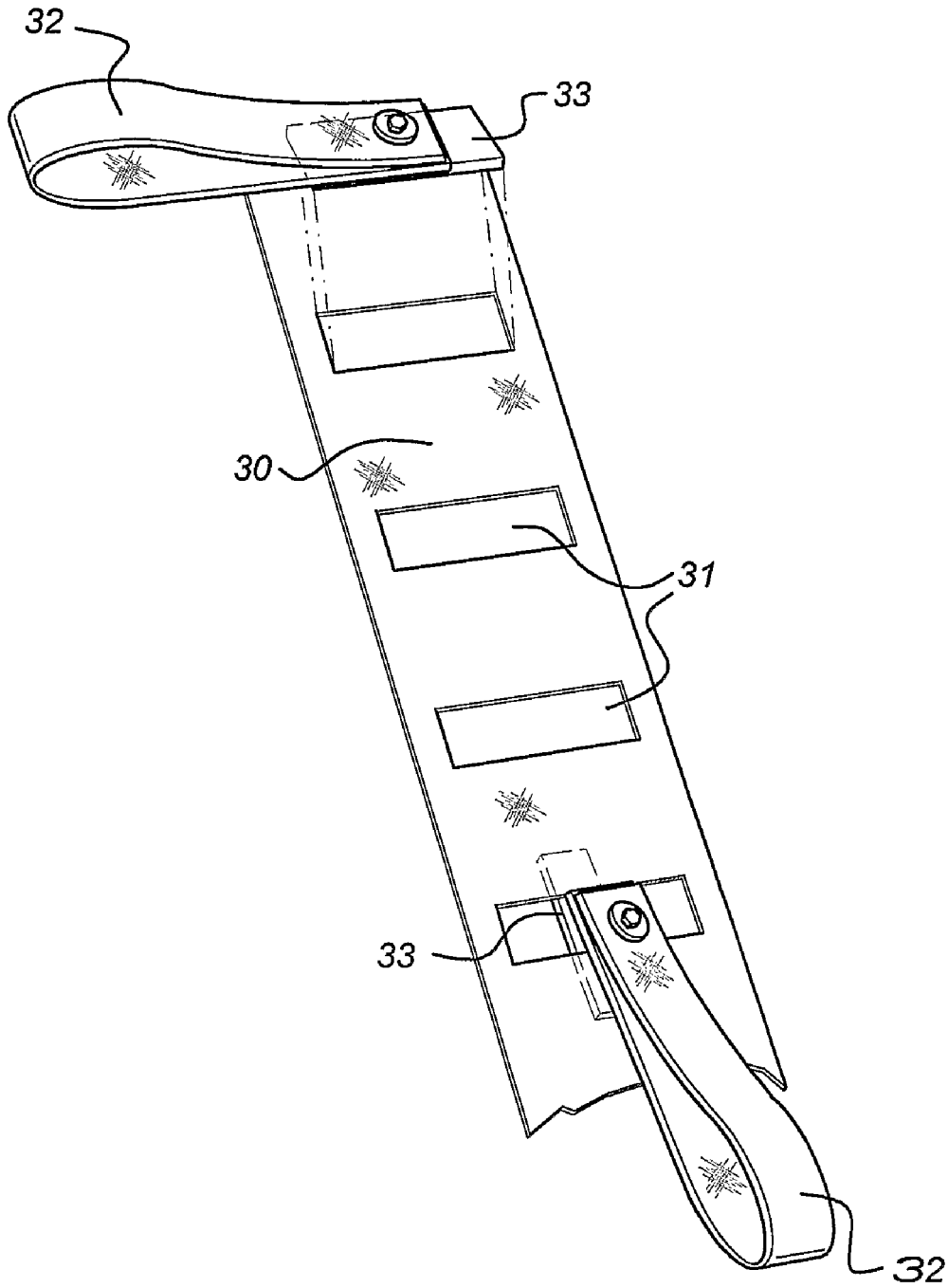
FIG. 4 shows a variant of the construction described above.

In FIG. 4 a variant of the belt 10 described above is indicated by 30. This is not provided with loops but with a number of rectangular openings located a regular distance apart.

The loops are indicated by 32 and are provided at the end with a fixing section 33. This is fashioned for insertion through the opening 31 to provide secure locking with belt 30 after turning. In a manner that is not shown in more detail, this construction is made such that there is either a perfect connection between component 33 and belt 30 or there is no connection at all.

Figure 5:
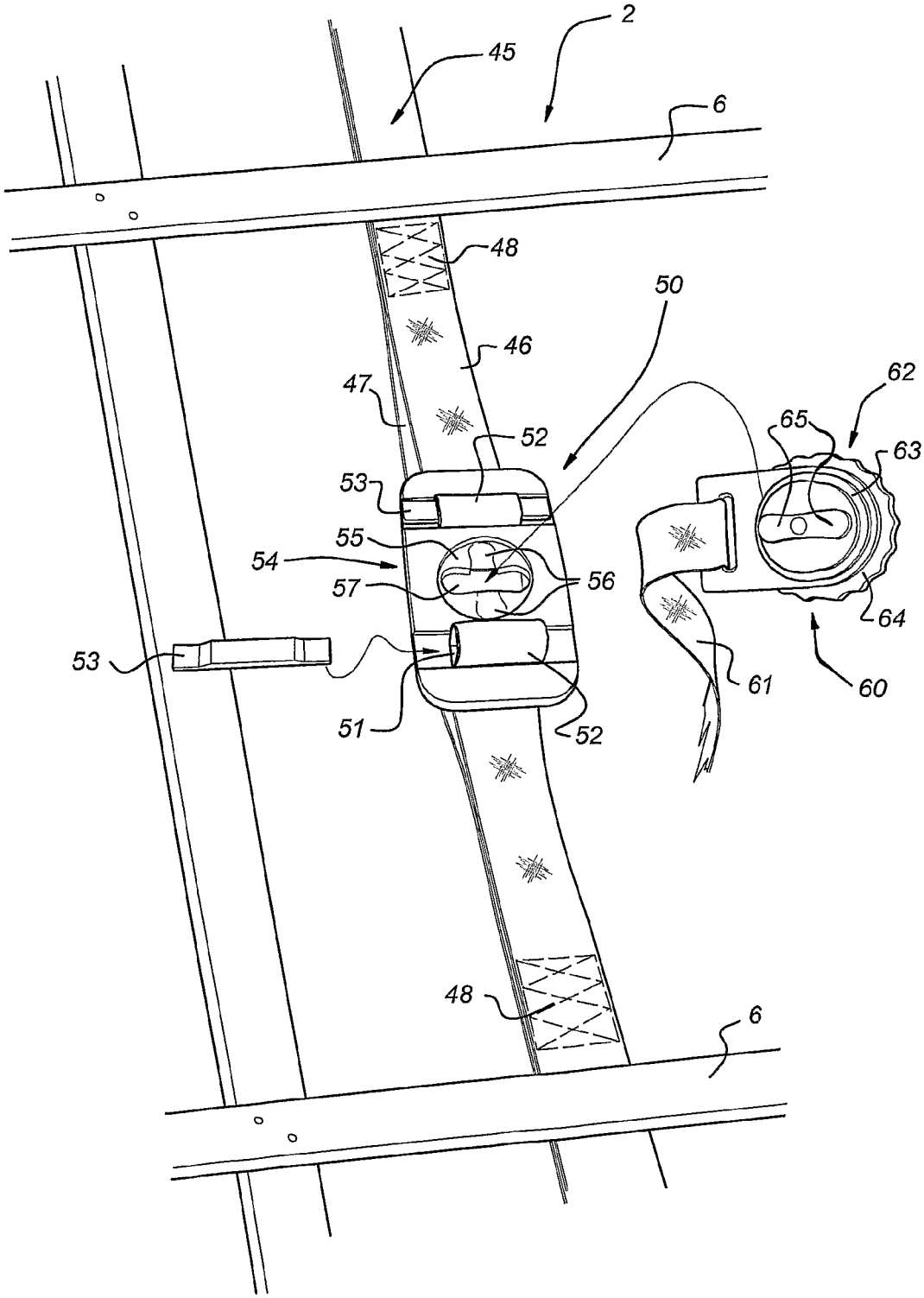
FIG. 5 shows a further variant of the present invention.

A variant of the present invention is shown in FIG. 5. A roof 2 is shown, on which a belt 45 has been provided. This belt consists of belt parts 46 and 47. Belt part 47 is joined to roof 2 in some way or other, such as by gluing, screwing and the like. Belt part 46 is fixed to belt part 47 in periodic locations, for example with the aid of stitching 48. Belt part 46 is longer than belt part 47 between two locations 48.

According to the variant shown here anchorage 50, which is provided with two longitudinal slots 51, is positioned between two tile battens 6. These slots are designed to take loop parts 52 and belt part 46 through them. By then inserting locking strips 53, anchorage 50 is joined in an immovable manner to belt part 46 and thus to belt part 47.

Anchorage 50 is provided with a coupling part 54 consisting of a circular opening 55 with rear recess 56 and slots 57 opening into the rear recess.

A safety lanyard 60 is also shown in FIG. 5. This consists of a belt 61 and a further coupling part 62. The further coupling part consists of a bearer 63 that is joined to belt 61 and an operating knob 64 that can be turned relative thereto. Lips 65 can be rotated by this means. The various features are so designed that bearer 63 can be placed only in one position with respect to anchorage 50. Furthermore, the construction is preferably made self-seeking. If the locking lips 65 move through the openings 57 in that position the user notices that full engagement between bearer 63 and anchorage 50 takes place. By then turning knob 64 the locking lips 65 are moved away from the slots 57 into the rear recess 56 and locking takes place in this way. This can optionally be confirmed to the user by means of a distinctly audible click. It will be understood that constructions with locking lips 65 that can be moved by pushing can also be used, in which case the slots 57 are not needed and snapping into the rear recess takes place. The locking lips 65 can be moved inwards and unlocking can take place by turning or pushing knob 64.

Some or other construction known in the state of the art can be fastened to belt 61.

It will be understood that starting from the above concept there are many modifications and further possible applications. These are obvious after reading the above description and fall within the scope of appended claims.

The invention claimed is:

1. An assembly comprising a pitched roof and a belt fixed to said roof, which belt extends in the direction of the pitch of said roof, wherein said roof comprises a structural part comprising beams, provided with horizontal battens for supporting roof covering elements thereon and vertical battens for supporting said horizontal battens, said vertical battens providing a spacing for the horizontal battens from said structural part, said belt being provided in the spacing between the horizontal battens and said structural part and being fixed to said structural part under said horizontal battens and extends from top to bottom underneath said horizontal battens and between said vertical battens, said assembly comprising a safety lanyard and engagement members being arranged on said belt a regular distance apart, said engagement members being designed for coupling said safety lanyard thereto, wherein said belt extends underneath said horizontal battens without making contact with said horizontal battens.

2. The assembly according to claim 1, wherein said battens are fitted on spacers and said belt is installed between two spacers.

3. The assembly according to claim 1, wherein the structural part further includes a roof slab and said roof slab is supported by anchoring and wherein said belt is fixed to said anchoring through said roof slab at regular intervals over the height of said roof.

4. The assembly according to claim 1, wherein said engagement members comprise loops made in the gap between two adjacent horizontal battens.

5. The assembly according to claim 4, wherein said loops are made such that they are detachable from said belt.

6. The assembly according to claim 1, wherein said engagement members comprise an anchorage provided with a coupling part.

7. The assembly according to claim 1, wherein said belt comprises belt parts fixed to one another at periodic intervals.

8. The assembly according to claim 7, wherein one belt part is fixed to said roof and one belt part is fixed to said engagement member.

9. The assembly according to claim 1, comprising various belts installed alongside one another some distance apart on the roof.

10. The assembly according to claim 9, wherein linking means are fitted between said belts.

11. The assembly according to claim 9, wherein a further construction is installed on said linking means.

12. The assembly according to claim 10, wherein said linking means comprise a platform.

13. A method for installing a fastening point for safety measure on a pitched roof, comprising a roof slab and horizontal battens, supporting roof elements, fitted at a distance from the roof slab and vertical battens for supporting said horizontal battens and providing a spacing for said horizontal battens from a structural part of the roof, wherein a belt provided with engagement members designed for coupling a safety lanyard thereto is permanently fixed to the roof slab, which belt is provided in the spacing between the horizontal battens and the structural part of the roof and extends top to bottom between said vertical battens and underneath said horizontal battens, wherein said belt extends underneath said horizontal battens without making contact with said horizontal battens.

14. The method according to claim 13, wherein said fixing of said belt comprises gluing.

15. The method according to claim 13, wherein said engagement members are fastened to said belt after fixing said belt to said roof.

* * * * *